United States Patent [19]

Grethe

[11] Patent Number: 4,639,209

[45] Date of Patent: Jan. 27, 1987

[54] METHOD OF SPRAYING ADDITIVES IN AN INTENSIVELY MIXING MANNER INTO A COMBUSTION CHAMBER FOR BINDING SULFUR

[75] Inventor: Klaus Grethe, Gummersbach, Fed. Rep. of Germany

[73] Assignee: L. & C. Steinmüller GmbH, Gummersbach, Fed. Rep. of Germany

[21] Appl. No.: 724,195

[22] Filed: Apr. 17, 1985

[30] Foreign Application Priority Data

Nov. 15, 1984 [DE] Fed. Rep. of Germany ..... 3441726

[51] Int. Cl.[4] ..... F23J 7/00

[52] U.S. Cl. ..... 431/4; 110/345; 431/10; 431/190; 423/242

[58] Field of Search ..... 431/3, 4, 10, 165, 190; 423/242 A; 110/345

[56] References Cited

U.S. PATENT DOCUMENTS

| | | | |
|---|---|---|---|
| 3,746,498 | 7/1973 | Stengel | 431/4 |
| 4,331,638 | 5/1982 | Michelfelder | 431/4 X |
| 4,439,137 | 3/1984 | Suzuki et al. | 431/10 X |
| 4,440,100 | 4/1984 | Michelfelder et al. | 431/4 X |
| 4,452,765 | 6/1984 | Peterson et al. | 423/242 A |
| 4,555,996 | 12/1985 | Torbov et al. | 431/4 X |

OTHER PUBLICATIONS

"Chemical Engineering Progress", vol. 65, No. 12, Dec., 1969, pp. 61–63, H. L. Falkenberry and A. V. Slack.

*Primary Examiner*—Margaret A. Focarino
*Attorney, Agent, or Firm*—Becker & Becker, Inc.

[57] ABSTRACT

A method of spraying additives, in an intensively mixing manner, into a combustion chamber for binding sulfur during the combustion of fuels which contain sulfur. The method includes the steps of spraying the respectively utilized additive into the combustion chamber with at least one spray nozzle at an impulse which is sufficient to intensively mix the additive with the combustion gases, and of spraying the additive into those regions of the combustion chamber which have temperatures in the optimum effective range of the additive for binding the sulfur, yet in which the mixing energy of the combustion gases does not alone ensure a sufficient mixing of the additive.

7 Claims, 8 Drawing Figures

AIR
AIR
OIL
AIR
FIG. Ib
FIG. Ia
1
2
3
4
5
6
7
8

METHOD OF SPRAYING ADDITIVES IN AN INTENSIVELY MIXING MANNER INTO A COMBUSTION CHAMBER FOR BINDING SULFUR

BACKGROUND OF THE INVENTION

1. Field of the Invention

The present invention relates to a method of spraying additives, in an intensively mixing manner, i.e. at high mixing energy, into a combustion chamber for capturing or binding sulfur during the combustion of fuels which contain sulfur.

2. Description of the Prior Art

Methods for mixing additives, which bind sulfur-containing impurities, into the combustion gases during the combustion of sulfur-containing fuels are known, according to which the additives are introduced into the combustion chamber in various ways.

Pursuant to one known method, "Fortschrittsberichte, VDI-Zeitschrift" (Progress Reports, Journal of the Association of German Engineers), Series 6, Number 21, August 1968, the process includes spraying the additives in the form of white calcium hydroxide and dolomite calcium hydroxide into the combustion chamber, above the region of the flame, with the aid of air jets. The drawback of this known method is that the manner in which the additives are introduced into the combustion chamber does not assure binding of the sulfur by the additives for the reason that the relatively low mixing energy of the air jets is not sufficient for achieving a good mixing intensity of the reaction constituents. Furthermore, the mixing of the reaction constituents is effected for the most part in temperature ranges which do not assure optimum reaction conditions.

Pursuant to a further known method of the aforementioned general type (U.S. Pat. No. 4,331,638 Michaelfelder dated May 25, 1982, which belongs to the assignee of the present invention), pulverous additives, such as the oxides and hydroxides of the metals sodium, potassium, aluminum, calcium, and others, are added from the wall of the burner by means of a gaseous and/or liquid carrier-medium stream, accompanied by the formation of a veil which surrounds the flame of the burner. The drawback of this known method is that the manner of introducing the additive into the combustion chamber again does not assure the binding of the sulfur by the additives, in this case because adding the additives into the region of the flame, from the burner wall, results in a large portion of the additive quantity passing through that flame region having the highest temperatures, which prevents binding of the sulfur. This drawback is particularly serious during the combustion of liquid and/or gaseous fuels due to the intensive, high-temperature flames. A further drawback is that the possible injection locations for the additives are limited by the type of injection to those regions from which the intensive mixing regions of the flame can be reached.

An object of the present invention is to develop a method of the aforementioned general type for use with binding sulfur, which assures that during the addition of sulfur-binding additives, the latter are combined with the combustion gases in such a way that an intensive mixing is achieved in that temperature range which is optimum for the binding reactions.

BRIEF DESCRIPTION OF THE DRAWINGS

This object, and other objects and advantages of the present invention, will appear more clearly from the following specification in conjunction with the schematic drawings, in which.

SUMMARY OF THE INVENTION

Figure 1:
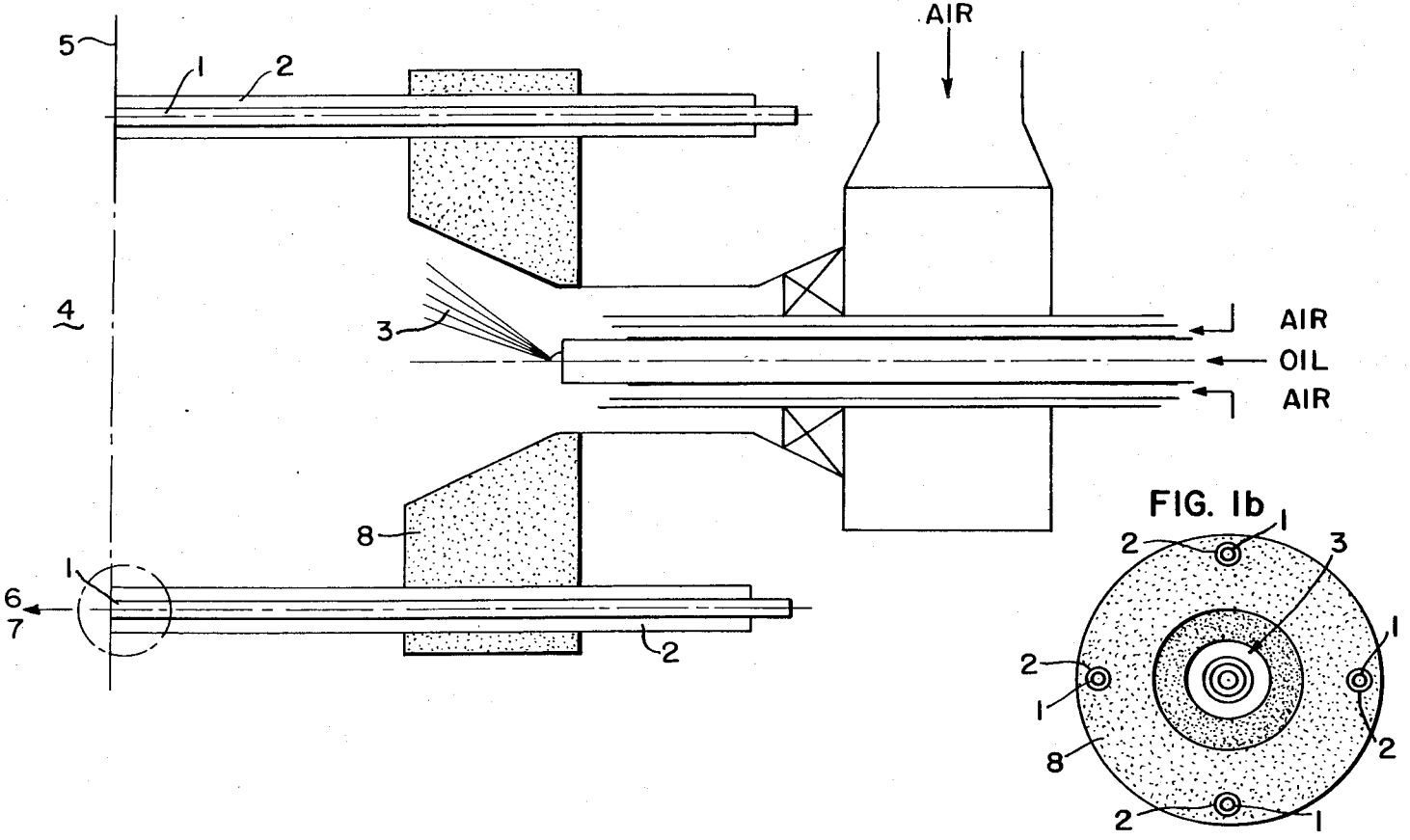
FIG. 1*a* illustrates one embodiment for utilizing the inventive method in connection with an annular oil burner.
FIG. 1*b* is a view taken from the left end of FIG. 1*a;*

The method of the present invention is characterized primarily by spraying the respectively utilized additive into the combustion chamber with at least one spray or atomizer nozzle at a momentum which is sufficient to intensively mix the additive with the combustion gases; furthermore, the additive is sprayed into those regions of the combustion chamber which have temperatures in the optimum effective range of the additive for binding the sulfur, yet in which the mixing energy of the combustion gases does not alone ensure a sufficient mixing of the additive.

Various embodiments of the spray nozzles can be utilized, including the arrangement of one or more spray nozzles having critical or over-critical discharge from the nozzles. These nozzles can be two-component nozzles having external mixing of additive and spraying medium. In particular, the additive, together with a small quantity of air as transport medium, discharges from the nozzle at a low velocity; due to the critical or over-critical discharge of the spraying or atomizing medium from a further nozzle opening, the additive and the combustion gases which surround the nozzle stream are drawn into the mixture pattern of the nozzle stream cone.

The spraying medium, for example, can be air or, to intensify the chemical binding of the sulfur, steam.

In the situation where combustion takes place in burner flames, the spray locations can be flame regions which are disposed downstream from the burner wall. The establishment of the spraying locations can be effected by a number of water-cooled lances which are uniformly distributed on at least part of a circle about the burner, and can be introduced into the combustion chamber through the burner wall; the spray nozzles are mounted on the front end of the lances.

As an alternative when combustion takes place in burner flames, the spray locations can also be points in one or more walls of the combustion chamber, with the points being disposed on a plane which is transverse to the main flow of the combustion chamber.

Since the location and type of addition of the additives in the range of temperature conditions which are optimum for the binding reactions, accompanied by the use of spray nozzles, are clearly prescribed, the physical conditions for the chemical reactions of the additives with the sulfur-containing compounds are optimally achieved.

DESCRIPTION OF PREFERRED EMBODIMENTS

The application of the inventive method will be subsequently described, for example, in conjunction with combustion via an annular oil burner, as well as in conjunction with combustion on a grate, in an underfeed firing, or pursuant to the IGNIT-FLUID method. IGNIT-FLUID refers to a trademark of the firm Fives-Cail-Babcock, Paris, and this method describes a firing on a declined grate, on which part of the coal bed is fluidized.

Referring now to the drawings in detail, FIGS. 1*a* and 1*b* illustrate one embodiment for an annular oil burner 3, with spray or atomizer nozzles 1 being disposed in water-cooled lances which can be introduced through the burner wall 8 into the combustion chamber 4 up to a location 5 which is disposed downstream from the burner wall 8. By means of the spray nozzles 1, the additive/air mixture 6, via a spraying or atomizing medium 7, is introduced into the combustion chamber 4 with a high impulse or momentum, and into the optimum temperature range, as illustrated with the view of FIG. 2.

Figure 3A:
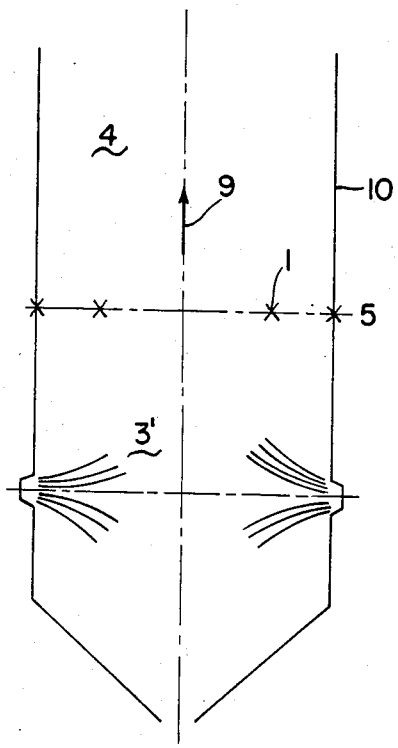
FIG. 3*a* illustrates another embodiment for utilizing the inventive methods.
Figure 3B:
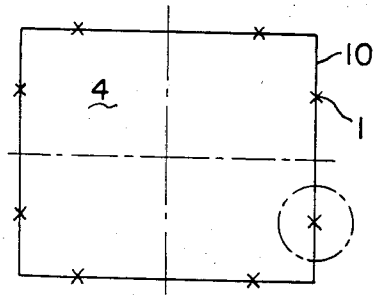
FIG. 3*b* is a view that shows cross section taken along the transverse plane of FIG. 3*a* in which the spray nozzles are located.

FIGS. 3*a* and 3*b* show an embodiment for the combustion in burner flames 3', with the locations for the disposition of the spray nozzles 1 being disposed in the combustion chamber walls 10 on a plane which is transverse to the main flow 9 of the combustion chamber 4.

Figure 4A:
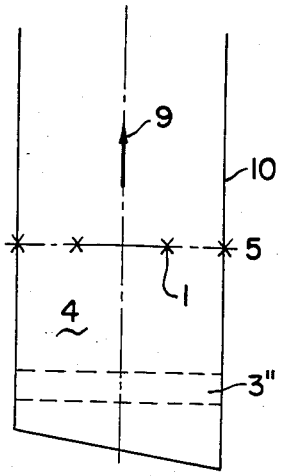
FIG. 4*a* illustrates a further embodiment utilizing the method of the present invention.
Figure 4B:
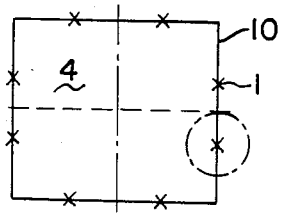
FIG. 4*b* a view that shows cross section taken along the transverse plane in FIG. 4*a* in which the spray nozzles are located.

FIGS. 4*a* and 4*b* show an embodiment for disposing the spray nozzles 1 at locations 5 which are disposed in the combustion chamber walls 10 on a plane transverse to the main flow 9 of the combustion chamber 4; this embodiment is designed for combustion on a grate, in an underfeed firing, or with the IGNIT-FLUID method 3''.

Figure 5:
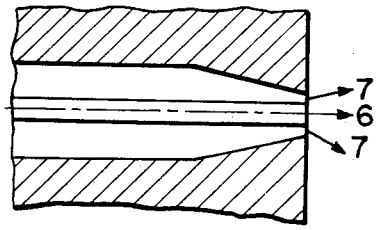
FIG. 5 is an enlarged view of the encircled portions of FIGS. 1*a,* 3*b,* and 4*b,* showing one embodiment of the spray nozzles.

FIG. 5 illustrates one possible embodiment for the spray nozzle 1 utilized in the embodiments illustrated in FIGS. 1 to 4. The additive/air mixture 6, and the spraying medium 7, flow out of separate nozzle openings. The critical or overcritical discharge of the spraying medium effects an intensive mixture of the surrounding combustion gases with the additive.

Figure 2:
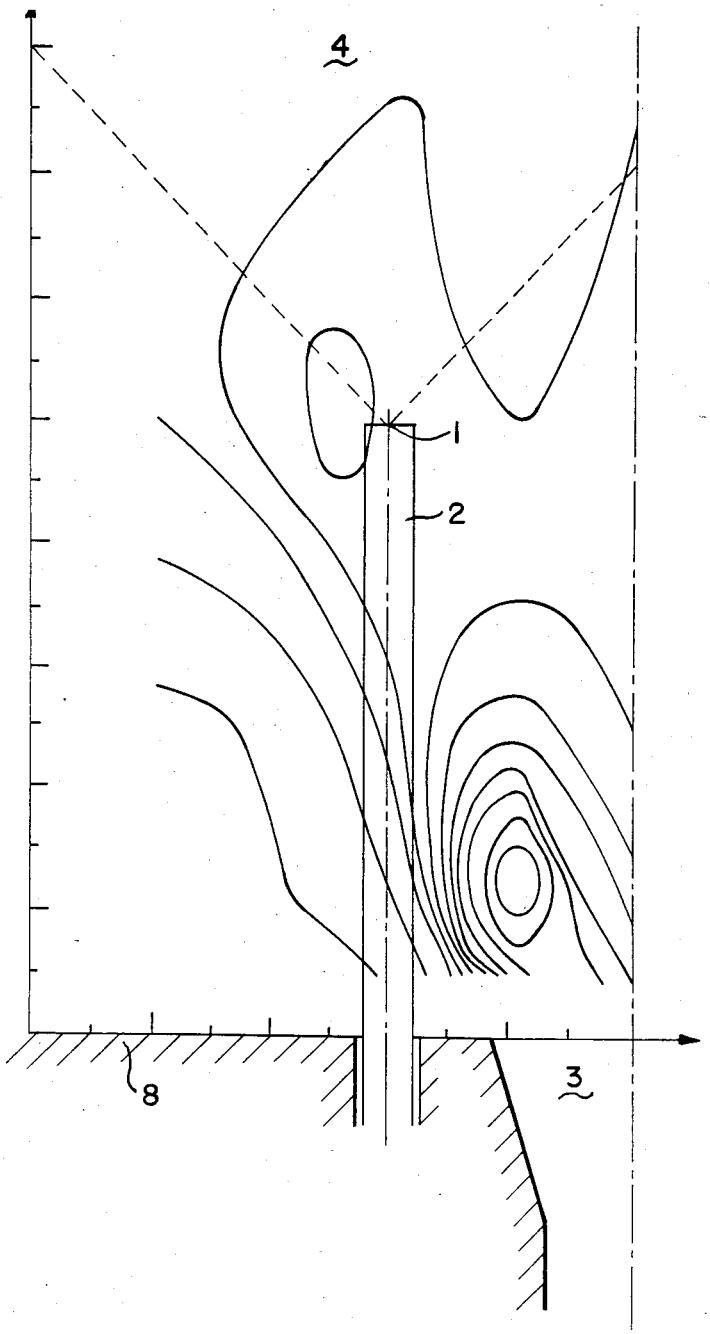
FIG. 2 is an enlarged view of a portion of FIG. 1*a* illustrating the flame intensity.

Tests under almost commercial proportions with the embodiment of FIGS. 1 and 2 yielded, for example, with the use of calcium hydroxide, a binding rate of the sulfur of up to greater than 80%, and with the use of limestone, a binding rate of approximately 60%; in each case, the molar ratio of Ca to S was 2.

The present invention is, of course, in no way restricted to the specific disclosure of the specification and drawings, but also encompasses any modifications within the scope of the appended claims.

What I claim is:

1. A method of spraying additives, in such a way that an intensive mixing occurs, into a combustion chamber for binding sulfur contained in combustion gases produced during the combustion of fuels which contain sulfur; said method comprising the steps of:

spraying the respectively utilized additive into said combustion chamber, with at least one spray nozzle, at a momentum which is sufficient to intensively mix said additive with said combustion gases;

utilizing, for said spraying, at least one spray nozzle having at least critical discharge;

spraying said additive into those regions of said combustion chamber which have temperatures in the optimum effective range of said additive for binding said sulfur, yet in which the mixing energy of said combustion gases does not alone ensure a sufficient mixing of said additive with said combustion gases; and utilizing as a spray nozzle a two-component nozzle, with said additive, together with a small quantity of air as carrier medium, being discharged from said nozzle at a low velocity, and with a spraying medium being discharged from a further nozzle opening of said nozzle at at least critical discharge to draw both said additive and said combustion gases, which surround the nozzle stream, into the mixture pattern of the nozzle stream cone.

2. A method according to claim 1, which includes the step of using air as spraying medium.

3. A method according to claim 1, which includes the step of using water vapor as spraying medium to intensify the chemical binding of said sulfur.

4. A method according to claim 1, which includes the steps of burning said sulfur-containing fuel in a burner flame, and disposing at least one spray location in a flame location which is downstream from the burner wall in said combustion chamber.

5. A method according to claim 4, which for establishing said spray locations, includes the steps of providing a number of water-cooled lances, of uniformly distributing said lances on at least a partial circle about said burner, of introducing said lances in said combustion chamber through said burner wall, and of mounting said spray nozzles onto the front end of said lances.

6. A method according to claim 1, which includes the steps of burning said sulfur-containing fuel in a burner flame, and disposing at least one spray location in at least one wall of said combustion chamber, and in a plane which is transverse to the main flow in said combustion chamber.

7. A method according to claim 1, which includes the steps of burning said sulfur-containing fuel on a grate, in an underfeed firing, or with the IGNIT-FLUID method, and disposing at least one spray location in at least one wall of said combustion chamber, and in a plane which is transverse to the main flow in said combustion chamber.

* * * * *